US007017798B2

(12) United States Patent
Pope et al.

(10) Patent No.: US 7,017,798 B2
(45) Date of Patent: Mar. 28, 2006

(54) FOOD-TRANSPORT TRAY

(75) Inventors: Ray Pope, Golden, CO (US); Nate Marsh, Arvada, CO (US); Stan Knierim, Indianapolis, IN (US)

(73) Assignee: TIN Inc., Austin, TX (US)

( * ) Notice: Subject to any disclaimer, the term of this patent is extended or adjusted under 35 U.S.C. 154(b) by 0 days.

(21) Appl. No.: 10/792,976

(22) Filed: Mar. 4, 2004

(65) Prior Publication Data

US 2004/0173493 A1 Sep. 9, 2004

Related U.S. Application Data

(60) Provisional application No. 60/452,880, filed on Mar. 7, 2003.

(51) Int. Cl.
*B65D 5/42* (2006.01)

(52) U.S. Cl. ..... 229/169; 206/506; 206/509; 206/518; 229/915

(58) Field of Classification Search ..... 229/169, 229/174, 915, 919; 206/506, 509, 518
See application file for complete search history.

(56) References Cited

U.S. PATENT DOCUMENTS

| | | | | |
|---|---|---|---|---|
| 2,588,455 | A * | 3/1952 | Adams | 229/915 |
| 3,580,475 | A * | 5/1971 | Mobley | 229/915 |
| 3,777,969 | A * | 12/1973 | Nurre | 229/169 |
| 3,899,121 | A * | 8/1975 | Herbetko | 206/509 |
| 4,569,474 | A * | 2/1986 | Buschor et al. | 206/509 |
| 4,667,825 | A * | 5/1987 | Durand | 229/169 |
| 4,785,992 | A * | 11/1988 | Goeppner | 206/509 |
| 4,974,773 | A * | 12/1990 | Alexander et al. | 229/915 |
| 5,535,942 | A * | 7/1996 | Vilona | 229/919 |
| 5,791,555 | A * | 8/1998 | Kanter | 229/169 |
| 6,116,498 | A * | 9/2000 | Sheffer | 229/169 |
| 6,581,772 | B1 * | 6/2003 | Noland | 206/509 |

FOREIGN PATENT DOCUMENTS

| | | | | |
|---|---|---|---|---|
| EP | 453015 | A2 * | 10/1991 | 229/169 |

* cited by examiner

*Primary Examiner*—Gary E. Elkins
(74) *Attorney, Agent, or Firm*—Baker & Daniels LLP

(57) ABSTRACT

An article-transport tray includes a floor, two side walls, and two end walls which cooperate to form an interior regions sized to contain bags of food or other articles. A partial cover is coupled to the side walls and is arranged to overlie the floor. The cover provides a top opening into the interior region formed in the tray.

30 Claims, 5 Drawing Sheets

FOOD-TRANSPORT TRAY

This application claims priority under 35 U.S.C. §119(e) to U.S. Provisional Application Ser. No. 60/452,880, filed Mar. 7, 2003, which is expressly incorporated by reference herein.

BACKGROUND

The present disclosure relates to trays, and particularly to stackable trays made of paperboard. More particularly, the present disclosure relates to a sturdy tray made of a corrugated material and configured to contain food or other items.

Various kinds of cartons or containers are used to pack packaged beef for delivery from a beef-packaging site to a retail store. Such containers are often plastic crates configured to be stacked on top of one another on a pallet to facilitate transport of the packaged beef or other packed items. These crates must be emptied at their destination and then shipped back to a beef-packaging site to be cleaned and then packed for reuse. Costs associated with return shipping and cleaning can be significant.

SUMMARY

An article-transport tray is adapted to transport food or other articles from one site to another. The tray includes a floor, two side walls, a right end closure coupled to the floor and side walls, and a left end closure coupled to the floor and side walls. These tray portions cooperate to form an interior article-receiving region above the floor.

Lower and upper tray-alignment guides are included in the right and left end closures. These guides are configured to mate with overlying and underlying trays to establish an aligned stack of trays.

In illustrative embodiments, the lower tray-alignment guide includes an inclined right tray-locator flange appended to one end of the floor and an inclined left tray-locator flange appended to an opposite end of the floor. The inclined right and left tray-locator flanges are arranged to extend upwardly from the floor and diverge in a direction extending away from the floor.

The upper tray-alignment guide includes an inclined right tray-locator rim arranged to lie above and in spaced-apart parallel relation to the inclined right tray-locator flange. The upper tray-alignment guide also includes an inclined left tray-locator rim arranged to lie above and in spaced-apart parallel relation to the inclined left tray-locator flange.

In use, each of the right and left tray-locator flanges provided near the floor of the tray face downwardly and mate and nest with upwardly facing right and left tray-locator rims provided in an underlying tray. Also, each of the right and left tray-locator rims provided above the floor of the tray face upwardly and mate and nest with downwardly facing right and left tray-locator flanges in an overlying tray. Such mating and nesting among trays helps to maintain stacked trays in an aligned position relative to one another.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
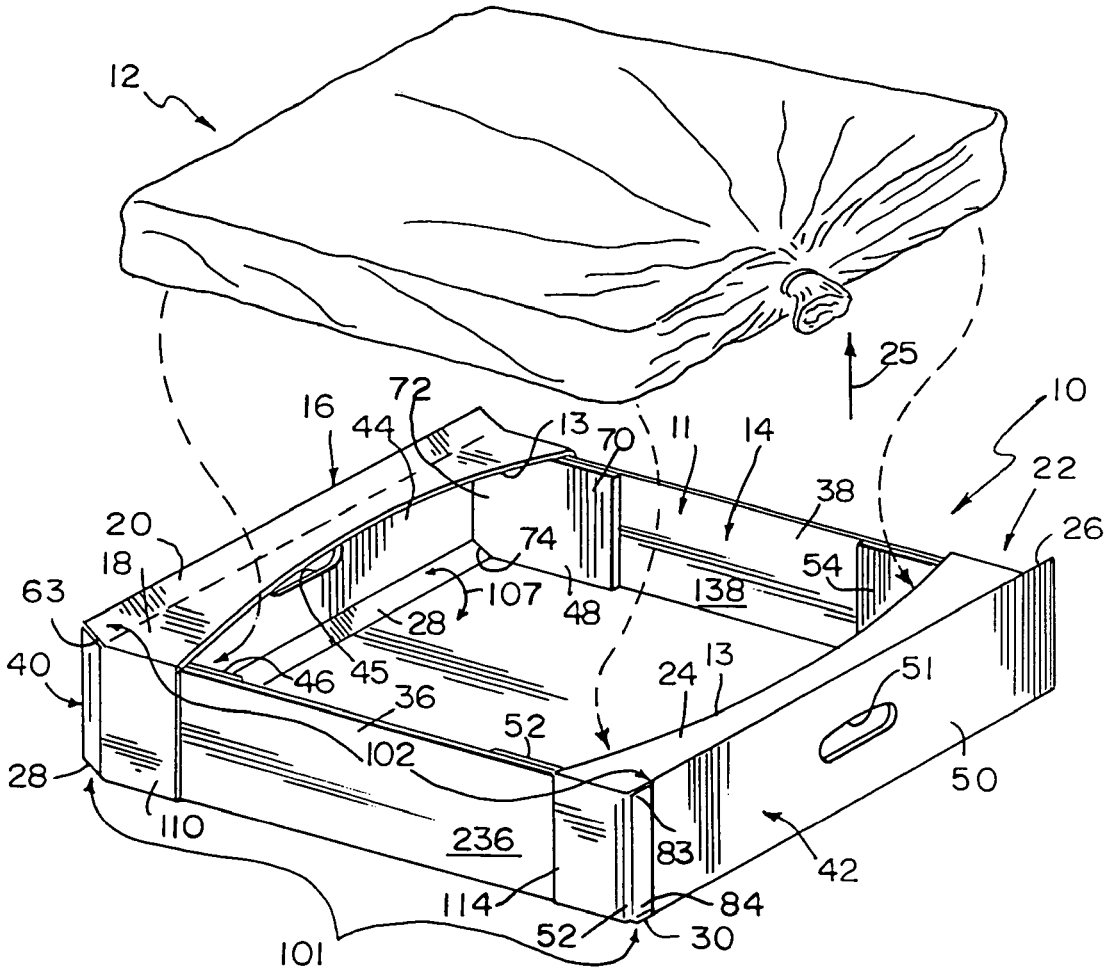
FIG. 1 is a perspective view of an erected article-transport tray in accordance with the present disclosure showing a floor, two side walls appended to the floor, two end walls formed to include hand-receiving slots, an inclined left tray-locator rim coupled to an upper portion of the left end wall and arranged to extend from one side wall to the other side wall, an underlying inclined left rim-engaging tray-locator flange arranged to interconnect the floor and a lower portion of the left end wall and to extend from one side wall to the other side wall under the inclined left tray-locator rim, and a tray opening sized to receive a deformable bag filled with individually wrapped meat packages or other suitable items.

An article-transport tray 10 is provided, as shown in FIG. 1, for carrying various items. Tray 10 is well-suited for carrying a deformable bag 12 containing, for example, ten to fifteen pounds of packaged fresh or frozen beef. Bag 12 can be deformed easily as suggested in FIG. 1 to fit through an opening 11 into an interior region 14 provided in tray 10 to assume a "stored" position therein as shown, for example, in FIG. 9. Trays 10 are configured to be stacked on top of one another as also shown in FIG. 9 to facilitate transport of filled trays 10 from, for example, a. meat-packaging plant to a grocery store.

Figure 2:
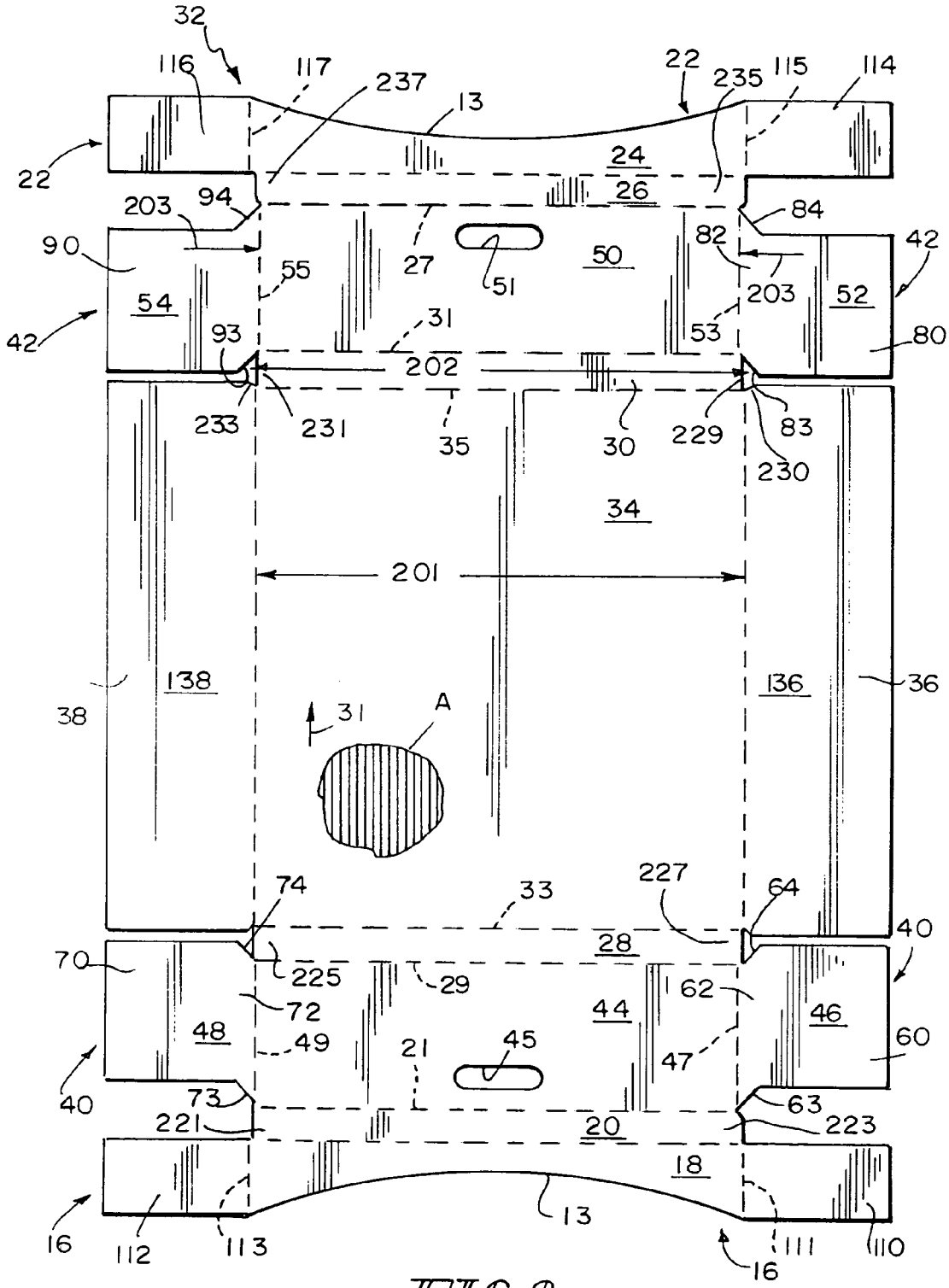
FIG. 2 is a plan view of a blank of corrugated material used to form the tray of FIG. 1.

Tray 10 includes, at one end, an inclined tray-locator rim 20 and a left cover strip 16 including a horizontal tray-support platform 18 appended to inclined left tray-locator rim 20 as shown in FIGS. 1 and 2. Tray 10 also includes, at an opposite end, an inclined right tray-locator rim 26 and a right cover strip 22 including a horizontal tray-support platform 24 appended to inclined right tray-locator rim 26.

Figure 9:
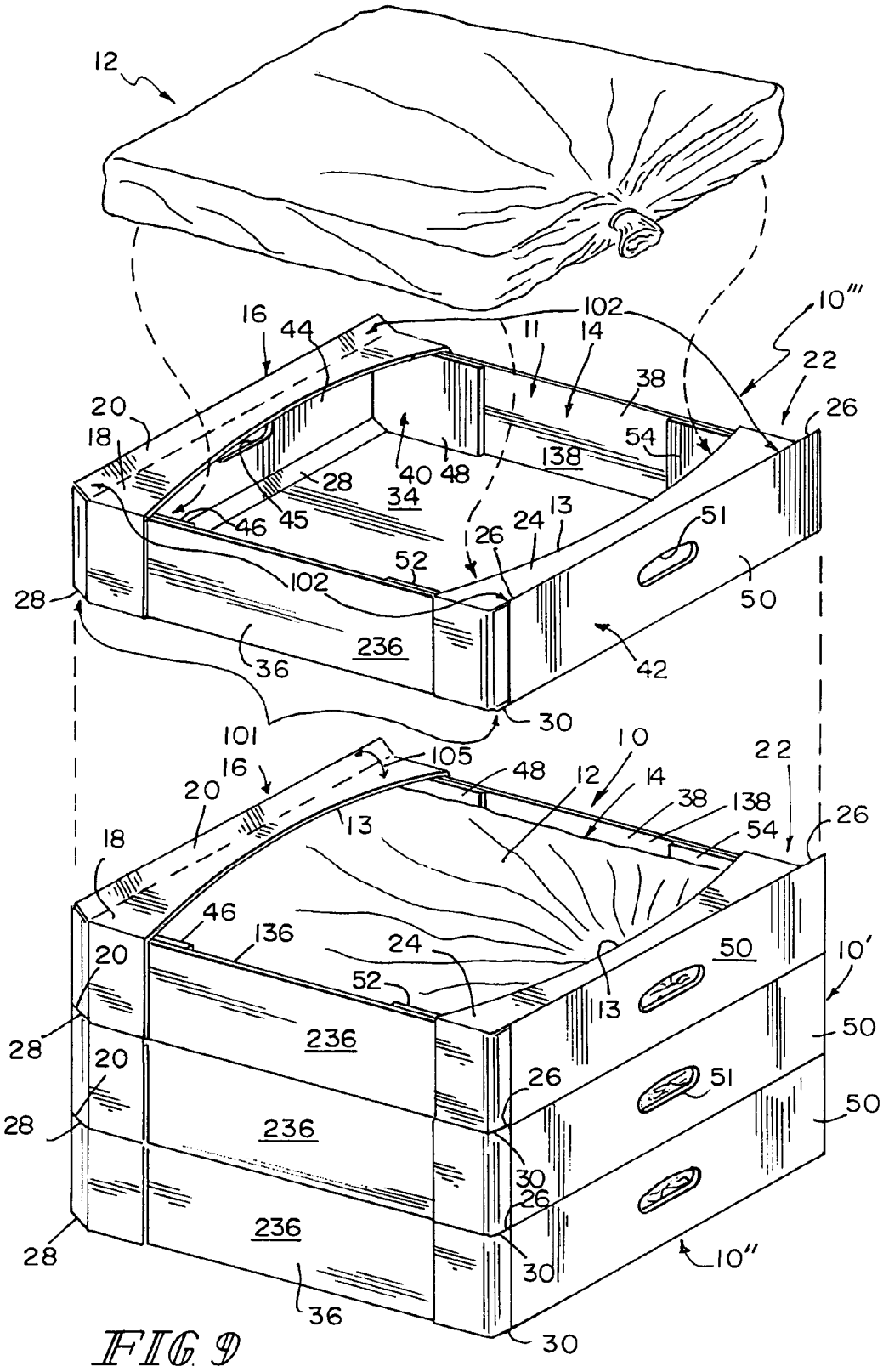
FIG. 9 is a perspective view showing several trays of the type shown in FIG. 1 stacked on top of one another so that the two separated, downwardly facing, inclined tray-locator flanges associated with one tray mate with and nest against the two separated, upwardly facing, inclined tray-locator rims associated with an underlying tray.

As suggested in FIG. 1, inclined left and right tray-locator rims 20, 26 are arranged to diverge in a direction 25 extending away from floor 14 and face upwardly in direction 25 to promote "nesting" engagement with a tray similar to tray 10 placed on top of tray 10 as suggested in FIG. 9. Inclined left and right tray-locator rims 20, 26 cooperate to form an upper tray-alignment guide 102 and with left and right horizontal tray-support platforms 18, 24 cooperate to mate with an underside of an overlying tray 10''' as suggested, for example, in FIG. 9 so that an aligned stack of nested trays can be created easily for storage or transit.

Each of horizontal tray-support platforms 18, 24 illustratively includes a concave, curved edge 13 as shown in FIG. 1. Tray-support platforms 18, 24 are positioned to lie in spaced-apart relation to one another as shown in FIG. 1 to provide a top opening 11 into interior region 14 of tray 10. Deformable bag 12 or other articles (not shown) can be placed in or removed from interior region 14 through that top opening 11.

Tray 10 also includes inclined rim-engaging left and right tray-locator flanges 28, 30 located at opposite ends of tray 10 and arranged to face downwardly as shown, for example, in FIG. 1. As suggested, for example, in FIG. 1, inclined left and right tray-locator flanges 28, 30 are arranged to diverge in direction 25 and cooperate to form a lower tray-alignment guide 101.

Each of these downwardly facing tray-locator flanges 28, 30 is sized and shaped to rest on one of the inclined left and right tray-locator rims 20, 26 provided on an underlying tray 10' when trays 10, 10' are stacked on top of one another to promote "nesting" engagement with a tray similar to tray 10 placed below tray 10 as suggested in FIG. 9. Thus, tray-locator flanges 28, 30 associated with a first tray 10 and tray-locator rims 20, 26 associated with an underlying tray 10' cooperate to provide means for aligning and/or retaining the first tray 10 in an aligned, stacked position above the underlying tray 10' when the first tray 10 is placed on the tray-support platforms 18, 24 of the underlying tray 10' as shown in FIG. 9 to provide a stack of aligned nested trays suitable for storage or for transport from one location to another.

Tray 10 is made from a blank 32 of corrugated material, as shown in FIG. 2, including a floor 34, left and right tray-locator flanges 28, 30 appended to floor 34, a first side wall 36, a second side wall 38, a left end strip 40 appended to left tray-locator flange 28, and a right end strip 42 appended to right tray-locator flange 30. Blank 32 also includes left cover strip 16, left tray-locator rim 20 appended to left cover strip 16 and to left end strip 40, right cover strip 22, and right tray-locator rim 26 appended to right cover strip 22 and to right end strip 42. The corrugation of blank 32 is positioned to run in longitudinal direction 31 as shown in insert A in FIG. 2.

Left end strip 40 includes a left end wall 44, a first end wall anchor flap 46 coupled to one end of left end wall 44 along a fold line 47, and a second end wall anchor flap 48 coupled to another end of left end wall 44 along a fold line 49 as shown in FIG. 2. Left end wall 44 is formed to include a hand-receiving slot 45 as shown, for example, in FIGS. 2 and 3.

Right end strip 42 includes a right end wall 50, a first end wall anchor flap 52 coupled to one end of right end wall 50 along a fold line 53, and a second end wall anchor flap 54 coupled to another end of right end wall 50 along a fold line 55 as also shown in FIG. 2. Right end wall 50 is formed to include a hand-receiving slot 51 as shown, for example, in FIGS. 1 and 2.

Referring now to FIG. 2, left end wall 44 is coupled to left tray-locator rim 20 along fold line 21 and to left tray-locator flange 28 along fold line 29. Likewise, right end wall 50 is coupled to right tray-locator rim 26 along fold line 27 and to right tray-locator flange 30 along fold line 31. Left ray-locator flange 28 is coupled to floor 34 along fold line 33 and right tray-locator flange 30 is coupled to floor 34 along fold line 35 as shown, for example, in FIG. 2.

First end wall anchor flap 46 of left end strip 40 includes a rectangle-shaped "outboard" portion 60 and a parallelogram-shaped "inboard" portion 62 as shown in FIG. 2. It is within the scope of this disclosure to vary the shapes of portions 60, 62 and other similar portions disclosed herein. Outboard portion 60 is sized to mate with an interior surface 136 of first side wall 36 as suggested in FIG. 1. Inboard portion 62 includes an upper inclined edge 63 (see FIG. 12) for underlying and supporting one end 223 (see FIG. 2) of inclined left tray-locator rim 20 when tray 10 is erected as suggested in FIGS. 1 and 3. Inboard portion 62 also includes a lower inclined edge 64 (see FIG. 2) for engaging one end 22 (see FIG. 2) of inclined left tray-locator flange 28 when tray 10 is erected as suggested in FIG. 1.

Second end wall anchor flap 48 of left end strip 40 includes a rectangle-shaped outboard portion 70 and a parallelogram-shaped inboard portion 72 as shown in FIG. 2. Outboard portion 70 is sized to mate with an interior surface 138 of second side wall 38 as suggested in FIGS. 1 and 3. Inboard portion 72 includes an upper inclined edge 73 (see FIG. 2) for underlying and supporting another end 221 (see FIG. 2) of inclined left tray-locator rim 20 when tray 10 is erected as suggested in FIGS. 1 and 3. Inboard portion 72 also includes a lower inclined edge 74 (see FIG. 2) for engaging another end 225 (see FIG. 2) of inclined left tray-locator flange 28 when tray 10 is erected as suggested in FIG. 1.

First end wall anchor flap 52 of right end strip 42 includes a rectangle-shaped outboard portion 80 and a parallelogram-shaped inboard portion 82 as shown in FIG. 2. Outboard portion 80 is sized to mate with an interior surface 136 of first side wall 36 as suggested in FIG. 1. Inboard portion 82 includes an upper inclined edge 84 (see FIG. 2) for underlying and supporting one end 235 (see FIG. 2) of inclined right tray-locator 26 when tray 10 is erected as suggested in FIGS. 1 and 3. Inboard parallelogram portion 82 also includes a lower inclined edge 83 (see FIG. 2) for engaging one end 229 (see FIG. 2) of inclined right tray-locator flange 30 when tray 10 is erected as suggested in FIG. 1.

Second end wall anchor flap 54 of right end strip 42 includes a rectangle-shaped outboard portion 90 and a parallelogram-shaped inboard portion 92 as shown in FIG. 2. Outboard portion 90 is sized to mate with an interior surface 138 of second side wall 38 as suggested in FIGS. 1 and 3. Inboard portion 92 includes an upper inclined edge 94 (see FIG. 2) for underlying and supporting another end 237 (see FIG. 2) of inclined right tray-locator rim 26 when tray 10 is erected as suggested in FIGS. 1 and 3. Inboard portion 92 also includes a lower inclined edge 93 (see FIG. 2) for engaging another end 231 (see FIG. 2) of inclined right tray-locator flange 28 when tray 10 is erected as suggested in FIG. 1.

Figure 7:
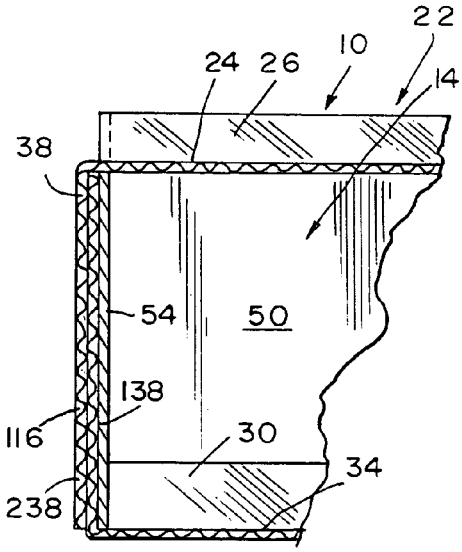
FIG. 7 is a sectional view taken along line 7—7 of FIG. 6.

As shown best in FIG. 2, left cover strip 16 further includes a first platform anchor flap 110 coupled to one end of left tray-support platform 18 along a fold line 111 and as second platform anchor flap 112 coupled to another end of left tray support platform 18 along a fold line 113. Likewise, right cover strip 22 further includes a first platform anchor flap 114 coupled to one end of right tray-support platform 24 along a fold line 115 and a second platform anchor flap 116 coupled to another end of right tray-support platform 24 along a fold line 117. The first platform anchor flaps 110, 114 are mated and fixed (using any suitable means) to an exterior surface 236 of first side wall 36 while the second platform anchor flaps 112, 116 are mated and fixed (using any suitable means) to an exterior surface 238 (see FIG. 7) of second side wall 38 as suggested in FIGS. 1, 4, 7, and 8 to establish a rigid and sturdy tray 10.

A lower tray-alignment guide 101 is associated with floor 34 as suggested in FIG. 1 and adapted to mate and nest with an underlying tray to establish an aligned stack of trays. An upper tray-alignment guide 102 is located above lower tray alignment guide 101 as suggested in FIG. 1. Upper tray-alignment guide 102 is adapted to mate and nest with an overlying tray to establish an aligned stack of trays. Lower and upper tray-alignment guides 101,102 cooperate to define a "tray aligner" for use in the manner suggested in FIG. 9.

Lower tray-alignment guide 101 includes an inclined right tray-locator flange 30 arranged to interconnect the first end of floor 34 and the lower boundary of right end strip 42 and an inclined left tray-locator flange 28 arranged to interconnect the second end of floor 34 and the lower boundary of left end strip 40. Inclined right and left tray-locator flanges 30, 28 are arranged to diverge in direction 25 extending away from floor 34 and toward the lower boundaries of right and left end straps 42, 40 as suggested in FIGS. 1 and 3.

Figure 6:
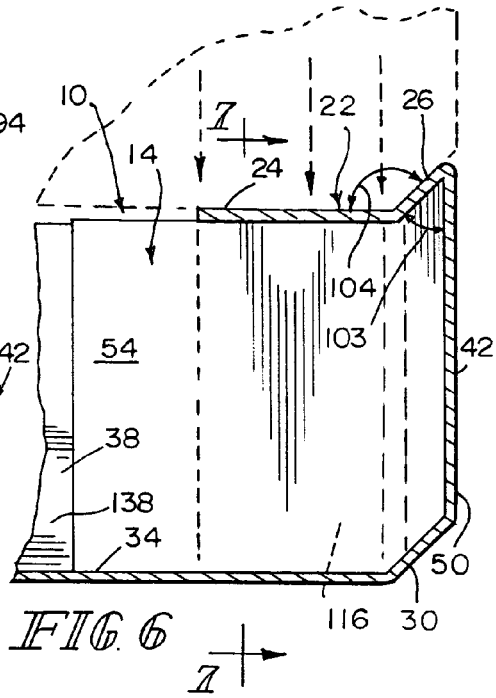
FIG. 6 is a sectional view similar to FIG. 5 showing completed folding of the right cover strip to assume the position shown in FIG. 1.
Figure 8:
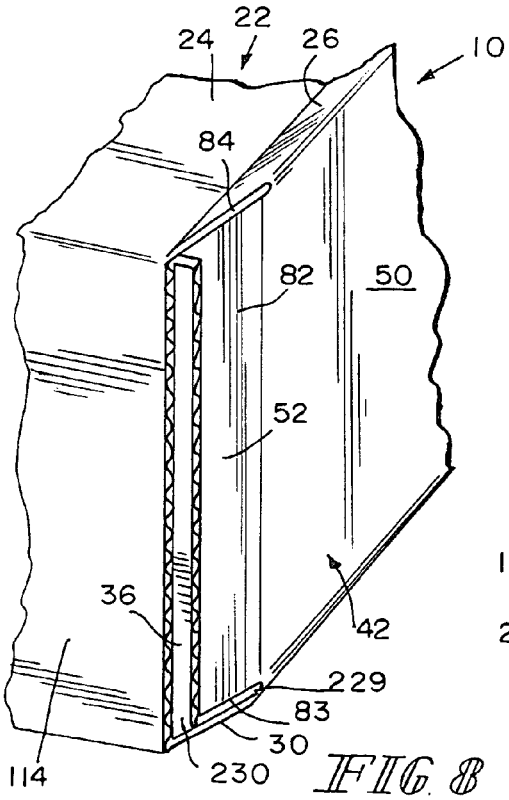
FIG. 8 is an enlarged perspective view of a portion of the near right corner of the tray of FIG. 1 showing portions of the inclined right tray-locator rim and the underlying inclined right tray-locator flange.

Upper tray-alignment guide 102 includes an inclined right tray-locator rim 26 appended to right end wall 50 along a fold line 27 and a right cover strip 22 appended to inclined right tray-locator rim 26 and to first and second side walls 36, 38 to cause inclined right tray-locator rim 26 and right end wall 50 to define an acute included angle 103 therebetween, as suggested in FIG. 6. A similar acute included angle is formed between left end wall 44 and inclined left tray-locator rim 20 as suggested in FIG. 1. Inclined right tray-locator rim 26 is located above and in spaced-apart parallel relation to inclined right tray-locator flange 30. An obtuse included angle 104 is defined between right tray-locator rim 26 and tray-support platform 24 as suggested in FIG. 6.

Upper tray-alignment guide 102 further includes an inclined left tray-locator rim 20 appended to left end wall 44 included in left end strip 40 and arranged to extend between first and second side walls 36, 38. Inclined left tray-locator rim 20 is appended to tray-support platform 18 to define an obtuse included angle 105 (see FIG. 9) therebetween. In the illustrated embodiment, angles 104 and 105 are substantially equivalent.

Inclined right and left tray-locator rims 26, 20 are arranged to diverge in direction 25 extending away from floor 34. Inclined right tray-locator rim and flange 26, 30 are arranged to lie in spaced-apart parallel relation to one another, as suggested in FIG. 1. Inclined left tray-locator rim and flange 20, 28 are also arranged to lie in spaced-apart parallel relation to one another.

First end wall anchor flap 52 of right end strip 40 includes a lower inclined edge 83 mating with inclined right tray-locator flange 30. Second end wall anchor flap 54 of right end strip 42 includes a lower inclined edge 93 mating with inclined right tray-locator flange 30.

First end wall anchor flap 52 includes an outboard portion 80 coupled to first side wall 36 and an inboard portion 82 coupled to right end wall 50 along a fold line 53 therebetween and arranged to interconnect right end wall 50 and outboard portion 80. Inboard portion 82 includes lowered inclined edge 83 of first end wall anchor flap 52. First side wall 36 includes an interior surface 136 facing toward second side wall 38. First side wall 36 includes a first lower inclined edge 230 mating with inclined right tray-locator flange 30 as suggested in FIG. 8. Similarly, a first lower inclined edge 233 of second wall 38 mates with inclined right tray-locator flange 30. The same is true in the illustrated embodiment at the opposite end wherein second lower inclined edges (not shown) of first and second walls 36, 38 mate with inclined left tray-locator flange 28. The first lower inclined edges of first and second wall anchor flaps 46, 48 are arranged to lie in substantially spaced-apart parallel relation to one another.

Floor 34 has a width dimension 201 extending between first and second side walls 36, 38. Right tray-locator flange 30 has a width dimension 202 that is about equal to the width dimension 201 of floor 34. Right end wall 50 has a width dimension 203 extending between first and second end wall anchor flaps 52, 54. Width dimension 203 is less than width dimensions 201 and 202 in the illustrated embodiment.

First end wall anchor flap 52 is angled with respect to right end wall 50 to mate with inclined right tray-locator flange 30 to define a first outboard ledge 229 mating with first side wall 36. First side wall 36 includes a lower inclined edge 230 mating with first outboard ledge 229 defined on inclined right tray-locator flange 30.

Figure 3:
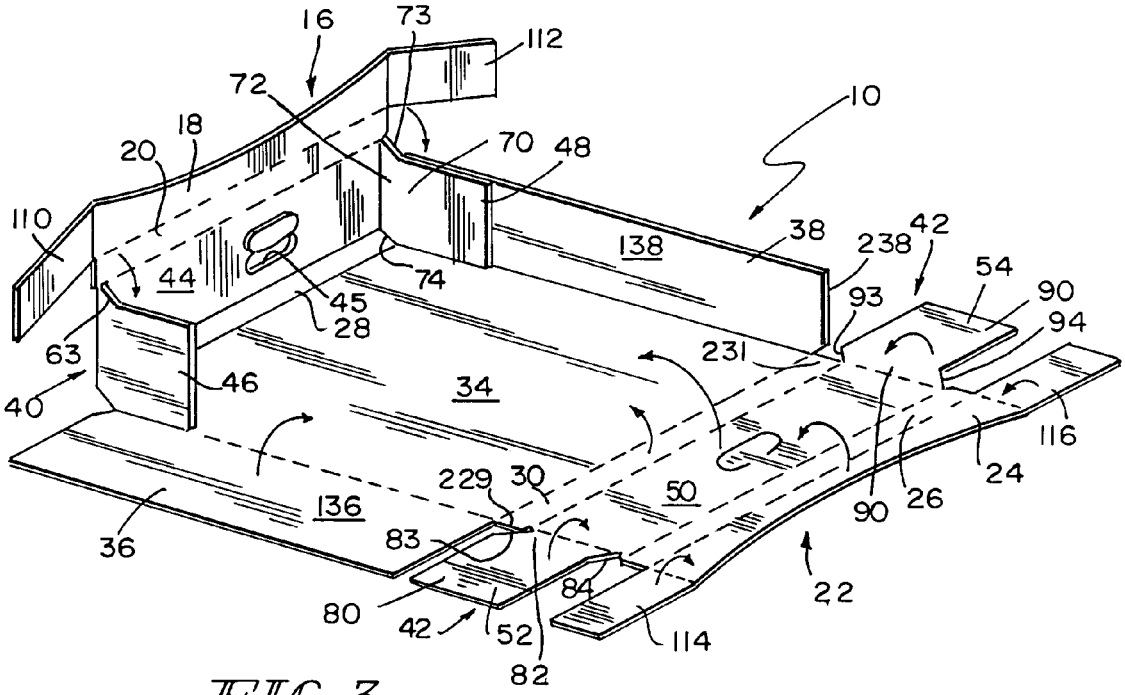
FIG. 3 is a perspective view of the blank of FIG. 2 being folded to erect the end walls and side walls of the tray of FIG. 1.
Figure 4:
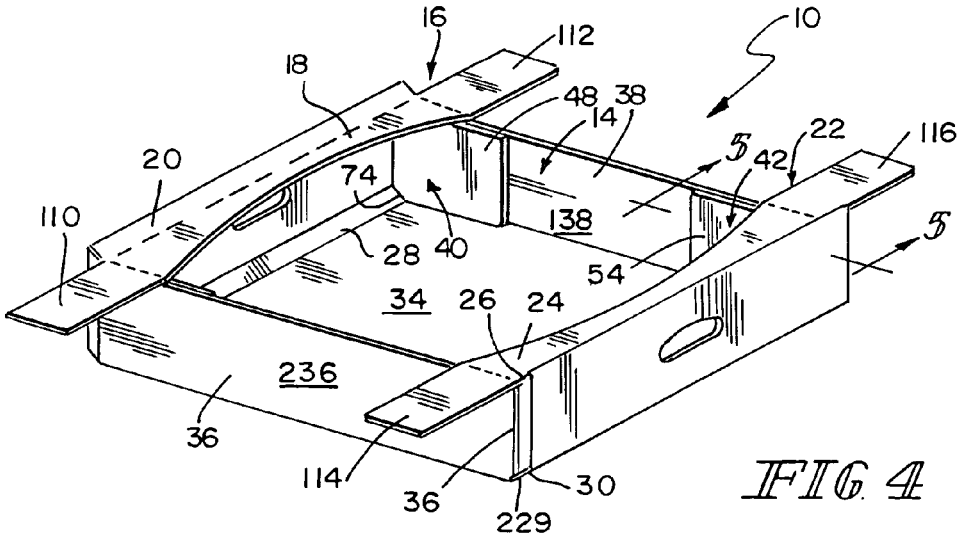
FIG. 4 is a view similar to FIG. 3 showing further folding of portions of the left and right cover strips included in the blank of corrugated material and appended, respectively, to the inclined left and right tray-locator rims to produce tray support means for supporting another tray on top of the tray shown in FIG. 4 in the manner shown, for example, in FIG. 9.

Second end wall anchor flap 54 is angled with respect to right end wall 50 to mate with inclined right tray-locator flange 30 to define a second outboard ledge 231 suggested in FIGS. 1 and 3 mating with second side wall 38. Second side wall 38 includes a lower inclined edge 233 mating with second outboard ledge 231 defined on inclined right tray-locator flange 30. Similar outboard ledges 225, 227 are provided on inclined left tray-locator flange 28 as suggested in FIG. 2 and these ledges are arranged to mate with lower inclined edges of first and second side walls 36, 38.

First end wall anchor flap 52 includes a first parallelogram-shaped inboard portion 82 appended to right end wall 50 along a fold line 53 therebetween and first outboard portion 80 appended to first parallelogram-shaped inboard portion includes a lower inclined edge 83 mating with inclined right tray-locator flange 30 and an upper inclined edge 84. Horizontal tray-support platform 24 overlies first outboard portion 80 and inclined right tray-locator rim 26 interconnects right end wall 50 and horizontal tray-support platform 24 and mates with upper inclined edge 84 of first parallelogram-shaped inboard portion 82.

Second end wall anchor flap 54 includes a second parallelogram-shaped inboard portion 92 appended to right end wall 50 along a fold line 55 therebetween and a second outboard portion 90 appended to second parallelogram-shaped inboard portion 92 and coupled to inner surface 138 of second side wall 38. Second parallelogram-shaped inboard portion 92 includes a lower inclined edge 93 mating with inclined right tray-locator flange 30 and an upper inclined edge 94. Horizontal tray-support platform 24 overlies second outboard portion 90. Inclined right tray-locator rim 26 mates with upper inclined edge 94 of second parallelogram-shaped inboard portion 92 to lie in substantially spaced-apart parallel relation to inclined right-tray locator flange 30.

Figure 5:
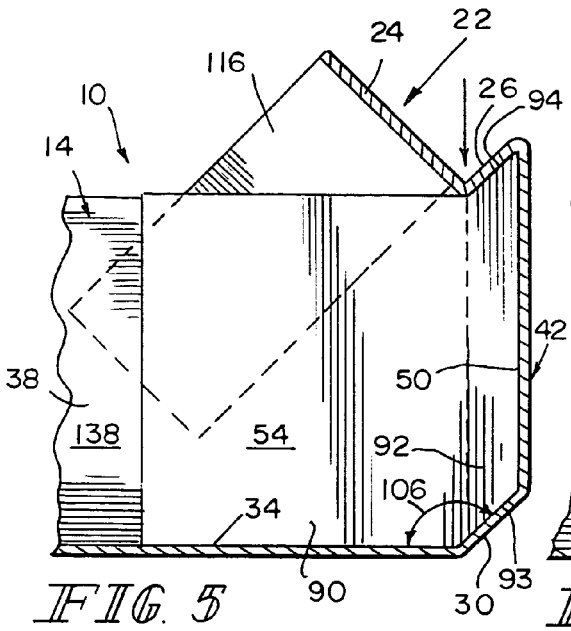
FIG. 5 is a sectional view taken "generally" along line 5—5 showing folding of portions of the right cover strip to establish the position of the inclined right tray-locator rim relative to the right end wall but before the right cover strip is folded fully to assume the position shown in FIG. 4.

Inclined right tray-locator flange 30 cooperates with floor 34 to define a first obtuse included angle 106 therebetween as suggested in FIG. 5. Left tray-locator flange 28 cooperates with floor 34 to define a second obtuse included angle 107 therebetween as suggested in FIG. 1. First and second obtuse included angles 106, 107 are substantially equivalent to one another. Upper tray-alignment guide 102 is located above floor 34 and adapted to mate and nest with an overlying tray to establish an aligned stack of trays. Upper tray-alignment guide 102 includes an inclined right tray-locator rim 26 located above and in spaced-apart parallel relation to inclined right tray-locator flange 30 and an inclined left tray-locator rim 20 located above and in spaced-apart parallel relation to inclined left tray-locator flange 28.

The invention claimed is:

1. An article-transport tray comprising a floor having two sides and two ends, a first side wall appended to the floor along a first side of the floor, a second side wall appended to the floor along a second side of the floor and arranged to lie opposite to the first side wall, a right end strip coupled to the first and second side walls, the right end strip having a lower boundary arranged to lie in spaced-apart relation to a first end of the floor, a left end strip coupled to the first and second side walls to locate the floor between the left and right end strips, the left end strip having a lower boundary arranged to lie in spaced-apart relation to a second end of the floor, and a lower tray-alignment guide associated with the floor and adapted to mate and nest with an underlying tray to establish an aligned stack of trays, the lower tray-alignment guide including an inclined right tray-locator flange arranged to interconnect the first end of the floor and the lower boundary of the right end strip and an inclined left tray-locator flange arranged to interconnect the second end of the floor and the lower boundary of the left end strip, the inclined right and left tray-locator flanges being arranged to diverge in a direction extending away from the floor and toward the lower boundaries of the right and left end strips.

2. The tray of claim 1, wherein the right end strip includes a right end wall extending between the first and second side walls and including the lower boundary of the right end strip, a first end wall anchor flap appended to the right end wall along a fold line therebetween and coupled to the first side wall, and a second end wall anchor flap appended to the right end wall along a fold line therebetween and coupled to the second side wall to cooperate with the first end wall anchor flap to establish a fixed position of the inclined right tray-locator flange relative to the floor and to the right end wall.

3. The tray of claim 2, further comprising an upper tray-alignment guide adapted to mate and nest with an overlying tray to establish an aligned stack of trays, the upper tray-alignment guide including an inclined right tray-locator rim appended to the right end wall along a fold line therebetween and a right cover strip appended to the inclined right tray-locator rim and to the first and second side walls to cause the inclined right tray-locator rim and the right end wall to define an acute included angle therebetween.

4. The tray of claim 3, wherein the inclined right tray-locator rim is located above and in spaced-apart parallel relation to the inclined right tray-locator flange.

5. The tray of claim 3, wherein the right cover strip includes a right horizontal tray-support platform appended to a lower boundary of the inclined right tray-locator rim and arranged to extend between the first and second side walls, a first platform anchor flap appended to the right horizontal tray-support platform along a fold line therebetween and coupled to the first side wall, and a second platform anchor flap appended to the right horizontal tray-support platform along a fold line therebetween and coupled to the second side wall to cooperate with the first platform anchor flap to establish a fixed position of the inclined right tray-locator rim relative to the right end wall.

6. The tray of claim 3, wherein the upper tray-alignment guide further includes an inclined left tray-locator rim appended to a left end wall included in the left end strip and arranged to extend between the first and second side walls and the inclined right and left tray-locator rims are arranged to diverge in a direction extending away from the floor.

7. The tray of claim 6, wherein the inclined right tray-locator rim and flange are arranged to lie in spaced-apart parallel relation to one another and the inclined left tray-locator rim and flange are arranged to lie in spaced-apart parallel relation to one another.

8. The tray of claim 2, wherein the first end wall anchor flap of the right end strip includes a lower inclined edge mating with the inclined right tray-locator flange.

9. The tray of claim 8, wherein the first end wall anchor flap includes a lower inclined edge mating with the inclined right tray-locator flange and the second end wall anchor flap of the right end strip includes a lower inclined edge mating with the inclined right tray-locator flange.

10. The tray of claim 9, wherein the first end wall anchor flap of the right end strip includes an outboard portion coupled to the first side wall and an inboard portion coupled to the right end wall along a fold line therebetween and arranged to interconnect the right end wall and the outboard portion and the inboard portion includes the lower inclined edge of the first end wall anchor flap.

11. The tray of claim 9, wherein the first side wall includes an interior surface facing toward the second side wall, the first end wall anchor flap of the right end strip includes an outboard portion coupled to the interior surface of the first side wall and an inboard portion coupled to the right end wall along a fold line therebetween and arranged to interconnect the right end wall and the outboard portion, the inboard portion includes the lower inclined edge of the first end wall anchor flap, and the first side wall includes a lower inclined edge mating with the inclined right tray-locator flange.

12. The tray of claim 9, wherein the lower inclined edges of the first and second wall anchor flaps are arranged to lie in substantially spaced-apart parallel relation to one another.

13. The tray of claim 2, wherein the floor has a width dimension extending between the first and second side walls, the right tray-locator flange has a width dimension that is about equal to the width dimension of the floor, the right end wall has a width dimension extending between the first and second end wall anchor flaps, and the first end wall anchor flap is angled with respect to the right end wall to mate with the inclined right tray-locator flange to define a first outboard ledge mating with the first side wall.

14. The tray of claim 13, wherein the first side wall includes a lower inclined edge mating with the first outboard ledge defined on the inclined right tray-locator flange.

15. The tray of claim 13, wherein the second end wall anchor flap is angled with respect to the right end wall to mate with the inclined right tray-locator flange to define a second outboard ledge mating with the second side wall.

16. The tray of claim 15, wherein the second side wall includes a lower inclined edge mating with the second outboard ledge defined on the inclined right tray-locator flange.

17. The tray of claim 2, wherein the first end wall anchor flap includes a first parallelogram-shaped inboard portion appended to the right end wall along a fold line therebetween and a first outboard portion appended to the first parallelogram-shaped inboard portion and coupled to the first side wall, the first parallelogram-shaped inboard portion includes a lower inclined edge mating with the inclined right tray-locator flange and an upper inclined edge, and further comprising a horizontal tray support platform overlying the first outboard portion and an inclined tray-locator rim interconnecting the right end wall and the horizontal tray support platform and mating with the upper inclined edge of the first parallelogram-shaped inboard portion.

18. The tray of claim 17, wherein the second end wall anchor flap includes a second parallelogram-shaped inboard portion appended to the right end wall along a fold line therebetween and a second outboard portion appended to the second parallelogram-shaped inboard portion and coupled to the second side wall, the second parallelogram-shaped inboard portion includes a lower inclined edge mating with the inclined right tray-locator flange and an upper inclined edge, the horizontal tray support platform overlies the second outboard portion, and the inclined tray-locator rim mates with the upper inclined edge of the second parallelogram-shaped inboard portion to lie in substantially spaced-apart parallel relation to the inclined right tray-locator flange.

19. The tray of claim 1, wherein the inclined right tray-locator flange cooperates with the floor to define a first obtuse included angle therebetween and the left tray-locator flange cooperates with the floor to define a second obtuse included angle therebetween and the first and second obtuse included angles are substantially equivalent to one another.

20. The tray of claim 19, further comprising an upper tray-alignment guide located above the floor and adapted to mate and nest with an overlying tray to establish an aligned stack of trays, the upper tray-alignment guide including an inclined right tray-locator rim located above and in spaced-apart parallel relation to the inclined right tray-locator flange and an inclined left tray-locator rim located above and in spaced-apart parallel relation to the inclined left tray-locator flange.

21. The tray of claim 20, wherein the upper tray-alignment guide further includes a right horizontal tray-support platform appended to a lower boundary of the inclined right tray locator rim and arranged to lie in spaced-apart parallel relation to the floor and in engagement with the first and second side walls and a left horizontal tray-support platform appended to a lower boundary of the inclined left tray-locator rim and arranged to lie in spaced-apart parallel relation to the floor and in engagement with the first and second side walls and wherein the right and left horizontal tray-support platforms cooperate to form an opening into an interior article-receiving region defined by the floor and the first and second side walls.

22. The tray of claim 1, further comprising an upper tray-alignment guide adapted to mate with an overlying tray to establish an aligned stack of trays, the upper tray-alignment guide including inclined right and left tray-locator rims arranged to lie in spaced-apart relation to one another and to diverge in a direction extending away from the floor.

23. The tray of claim 22, wherein the inclined right tray-locator rim and flange are arranged to lie in spaced apart parallel relation to one another and the inclined left tray-locator rim and flange are arranged to lie in spaced-apart parallel relation to one another.

24. An article-transport tray comprising a floor having two sides and two ends, a first side wall appended to the floor along a first side of the floor, a second side wall appended to the floor along a second side of the floor and arranged to lie opposite to the fist side wall, a right cover strip coupled to the first and second side walls, the right cover strip including a right horizontal tray-support platform overlaying the floor and extending between the first and second side walls, a left cover strip coupled to the first and second side walls, the left cover strip including a left horizontal tray-support platform overlying the floor and extending between the first and second side walls to lie in spaced-apart relation to the right horizontal tray-support platform to form an opening into an interior article-receiving region defined by the floor, and the first and second side walls, a right end wall associated with a first end of the floor and the right cover strip and arranged to extend between the first and second side walls, a left end wall associated with an opposite second end of the floor and the left cover strip and arranged to extend between the first and second side walls, and a tray aligner including an inclined lower tray-alignment guide coupled to the floor and to the right and left end walls and to the right and left horizontal tray support platforms.

25. The tray of claim 24, wherein the inclined lower tray-alignment guide includes an inclined right tray-locator flange arranged to interconnect the first end of the floor and the right end wall and an inclined left tray-locator flange arranged to interconnect the second end of the floor and the left end wall.

26. The tray of claim 25, wherein the inclined upper tray-alignment guide includes an inclined right tray-locator rim arranged to interconnect the right end wall and the right horizontal tray-support platform and an inclined left tray-locator rim arranged to interconnect the left end wall and the left horizontal tray-support platform.

27. The tray of claim 26, wherein the inclined right tray-locator flange and rim are arranged to lie in spaced-apart parallel relation to one another and the inclined left tray-locator flange and rim are arranged to lie in spaced-apart parallel relation to one another.

28. The tray of claim 24, wherein the inclined upper tray-alignment guide includes an inclined right tray-locator rim arranged to interconnect the right end wall and the right horizontal tray-support platform and an inclined left tray-locator rim arranged to interconnect the left end wall and the left horizontal tray-support platform.

29. The tray of claim 24, wherein the inclined lower tray-alignment guide includes an inclined right tray-locator flange arranged to interconnect the first end of the floor and the right end wall, the inclined upper tray-alignment guide includes an inclined right tray-locator rim arranged to interconnect the right end wall and the right horizontal tray-support platform, and further comprising a first end wall anchor flap appended to the right end wall along a fold line therebetween and coupled to the first end wall and a second end wall anchor flap appended to the right end wall along a fold line therebetween and wherein the first end wall anchor flap includes a lower inclined edge mating with the inclined right tray-locator flange and an upper inclined edge mating with the inclined right tray-locator rim and the second end wall anchor flap includes a lower inclined edge mating with the inclined right tray-locator flange and an upper inclined edge mating with the inclined right tray-locator rim.

30. An article-transport tray comprising a floor having two sides and two ends, a first side wall appended to the floor along a first side of the floor, a second side wall appended to the floor along a second side of the floor and arranged to lie opposite to the first side wall, a right end closure including an inclined right tray-locator flange appended to the first end of the floor along a fold line therebetween, a right end wall appended to the inclined right tray-locator flange along a fold line therebetween, a first end wall anchor flap appended to the right end wall along a fold line therebetween and coupled to the first side wall, a second end wall anchor flap appended to the right end wall along a fold line therebetween and coupled to the second side wall, an inclined right tray-locator rim appended to the right end wall along a fold line therebetween and arranged to overlie the inclined right tray-locator flange, a right horizontal tray-support platform appended to the inclined right tray-locator rim along a fold line therebetween and arranged to overlie a portion of the floor, a first platform anchor flap appended to the right horizontal tray-support platform along a fold line therebetween and coupled to the first side wall, and a second platform anchor flap appended to the right horizontal tray-support platform along a fold line therebetween and coupled to the second side wall, and a left end closure including an inclined left tray-locator flange appended to the second end of the floor along a fold line therebetween, a left end wall appended to the inclined left tray-locator flange along a fold line therebetween, a first end wall anchor flap appended to the left end wall along a fold line therebetween and coupled to the first side wall, a second end wall anchor flap appended to the left end wall along a fold line therebetween and coupled to the second side wall, an inclined left tray-locator rim appended to the left end wall along a fold line therebetween and arranged to overlie the inclined left tray-locator flange, a left horizontal tray-support platform appended to the inclined left tray-locator rim along a fold line therebetween and arranged to overlie a potion of the floor, a first platform anchor flap appended to the left horizontal tray-support platform along a fold line therebetween and coupled to the first side wall, and a second platform anchor flap appended to the left horizontal tray-support platform along a fold line therebetween and coupled to the second side wall.

* * * * *